United States Patent [19]

Smith, Jr.

[11] Patent Number: 4,706,613

[45] Date of Patent: Nov. 17, 1987

[54] STEAM GENERATOR HAVING AN AUXILIARY RECIRCULATION PATH

[75] Inventor: Allen C. Smith, Jr., Bethel Park, Pa.

[73] Assignee: Westinghouse Electric Corp., Pittsburgh, Pa.

[21] Appl. No.: 920,091

[22] Filed: Oct. 17, 1986

[51] Int. Cl.[4] ..... F22B 1/02

[52] U.S. Cl. ..... 122/32; 122/34

[58] Field of Search ..... 122/32, 33, 34; 165/158, 164; 376/399

[56] References Cited

U.S. PATENT DOCUMENTS

| | | | |
|---|---|---|---|
| 3,175,954 | 3/1965 | Potter . | |
| 3,206,372 | 9/1965 | Kluge et al. . | |
| 3,253,998 | 5/1966 | Hackney . | |
| 3,280,004 | 10/1966 | Williams et al. . | |
| 3,809,610 | 5/1974 | Smith et al. . | |
| 3,916,844 | 11/1975 | Cassell | 122/32 |
| 3,939,805 | 2/1976 | Michel | 122/32 |
| 4,033,814 | 7/1977 | Bregeon et al. . | |
| 4,039,377 | 8/1977 | Andrieu et al. . | |
| 4,057,033 | 11/1977 | Schlicating | 122/32 |
| 4,187,147 | 2/1980 | Braun et al. . | |
| 4,502,419 | 3/1985 | Smith, Jr. | 122/32 |

*Primary Examiner*—Edward G. Favors

[57] ABSTRACT

An improved steam generator having an auxiliary recirculation path in its secondary side is disclosed herein, as well as an improved method for mixing wet lay-up chemicals therein. The invention is particularly applicable to nuclear steam generators of the type including a secondary shell that contains a quantity of water, a bundle of heat exchange tubes, and a tube wrapper that concentrically surrounds the tube bundle for defining a downcomer path. The auxiliary recirculation path allows the water present within the tube wrapper to circulate through the downcomer path when the water level within the secondary shell is lowered below the upper edge of the tube wrapper during maintenance operations. The auxiliary flowpath, when used in combination with nitrogen sparging, allows wet layup chemicals injected into the downcomer path of the generator to be rapidly and uniformly mixed throughout the entire water inventory in the secondary shell, thereby minimizing generator downtime and radiation exposure to maintenance personnel.

30 Claims, 8 Drawing Figures

STEAM GENERATOR HAVING AN AUXILIARY RECIRCULATION PATH

BACKGROUND OF THE INVENTION

1. Field of the Invention

This invention concerns an improved nuclear steam generator having an auxiliary recirculation path in its upper shell region for facilitating the prompt and uniform mixing of wet lay-up chemicals in its water inventory.

2. Description of the Prior Art

Various techniques for mixing wet-layup chemicals in nuclear steam generators are known in the prior art. The mixing of such chemicals within the water inventory contained within the secondary sides of such generators is necessary whenever the manways of the secondary side are opened, and ambient air is allowed to flow into the interior of the generator. Such an opening of the manways is necessary from time to time so that repairmen can perform routine inspections and maintenance operations within the generator. The air that flows into the generator from the manways air contains oxygen, some of which becomes dissolved in the water present within the shell of the secondary side of the generator. If left unchecked, this dissolved oxygen can substantially accelerate the corrosion deterioration of the heat exchanger tubes contained within the secondary shell. The purpose of the wet lay-up chemicals is to remove the dissolved oxygen within the water inventory, and to render the water slightly basic in order to retard the corrosion that occurs to the tubes within the generator. The introduction and mixing of these chemicals into the water of the secondary side of the generator is often accompanied by a nitrogen sparging process, wherein pressurized nitrogen is used to displace the oxygen-containing air within the secondary shell.

In order for the wet lay-up chemicals to be effective, they must be thoroughly mixed into all portions of the water inventory of the generator. To this end, prior art mixing techniques have introduced the sparging gas through the blow-down line located at the bottom of the secondary side so that the resulting bubble agitation of the water would mix the water and chemicals. To further effect the desired mixing, recirculation pumps have been used within the secondary shell. Unfortunately, none of these techniques has succeeded in thoroughly mixing the wet lay-up chemicals with the water in the generator in a short amount of time. This is a significant shortcoming since generator down-time is very expensive. However, before one can fully understand the deficiencies of prior art mixing techniques, some basic understanding of the structure of nuclear steam generators is necessary.

Nuclear steam generators of the Westinghouse design are comprised of three principal parts, including the aforementioned secondary side, a tubesheet in which a bundle of U-shaped heat exchanger tubes are mounted, and a primary side. The primary side receives hot, radioactive water heated by the nuclear reactor. The primary side conducts this water to the inlets of the U-shaped tubes that are mounted in the tubesheet. The tubesheet and the U-shaped tubes hydraulically isolate the primary from the secondary sides of the steam generator while thermally connecting them together, so that heat from the radioactive water in the primary side is transferred to the non-radioactive water in the secondary side. The hot, radioactive water transfers its heat through the walls of the bundle of U-shaped heat exchanger tubes contained within the secondary side to non-radioactive feedwater present in the shell of the secondary side of the generator, thereby converting this feedwater into non-radioactive steam.

Structurally, the nuclear steam generator resembles a vertically oriented cylindrical shell having an enlarged portion at its upper end (see FIGS. 1A and 1B). The primary side of the generator is a bowl-shaped vessel located at the bottom portion of the shell, while the secondary side is formed from the middle and enlarged upper portion of the shell. The middle portion of the cylindrical shell contains the previously mentioned bundle of U-shaped heat exchanger tubes, while the upper shell region encloses a bank of water separators that separate water droplets entrained in the steam generated by the tube bundle. In order to uniformly recirculate the water that is removed from the steam by the steam separators, the bundle of U-shaped tubes is surrounded by a generally cylindrically shaped tube wrapper that is concentrically spaced from the shell of the secondary side of the generator. The annular space between the inner surface of the shell and the outer surface of the tube wrapper forms a downcomer path for the water droplets that collect the stream down the inner walls of the shell from the water separators. The bottom edge of the tube wrapper is spaced a short distance from the tubesheet so that the water that flows down the downcomer path will be conducted into the water that surrounds the bundle of heat exchanger tubes.

Under normal operating conditions, the water level within the secondary side of the generator is always higher than the upper edge of the tube wrapper, but lower than the upper portion of the separators contained within the upper shell region. At such a level, the water contained in the interior of the tube wrapper is free to circulate through the tube bundle, over the upper edge of the tube wrapper, through the primary separators, and down the downcomer path defined between the outer wall of the tube wrapper and the inner wall of the secondary shell. From there, the water flows downwardly until it reaches the gap between the bottom edge of the tube wrapper and the upper surface of the tubesheet, where it flows back to the bottom of the tube bundle.

Unfortunately, the aforementioned recirculation path is broken whenever the level of the water within the secondary shell is brought down to a point near or below the upper edge of the tube wrapper. Such a lowering of the water level is necessary to afford repairmen access to the upper shell region of the generator so that they can perform maintenance operations. The lowering of the water, and the consequent breaking of the recirculation path between the tube bundle and the downcomer path makes it very difficult to quickly and uniformly mix the wet lay-up chemicals into the water inventory contained within the secondary side while the maintenance operations are in progress. The time required to complete the mixing not only increases generator down-time, but also increases the amount of radiation that the repairmen are exposed to while working within the secondary side of the generator.

In order to overcome the non-uniform mixing of these chemicals within the secondary side of the generator, two different mixing techniques were developed in the prior art. The first of these techniques was the injection of the sparging gas (which was normally nitrogen) into the bottom of the secondary side of the generator through the blow-down line. The small bubbles of nitrogen served to agitate the water surrounding the tube bundle, and to effectively mix the anti-corrosion wet lay-up chemicals injected into this region of the generator. However, because the recirculation path between the interior of the tube wrapper and the downcomer path was broken, the water held within the downcomer path would not readily circulate with the water surrounding the heat exchanger tubes. The end result was that a large amount of generator down time passed before the anti-corrosive wet lay-up chemicals were uniformly mixed throughout all parts of the water inventory contained in the secondary side. The second prior art technique employed was the installation of a pump and a plurality of hoses for forcing a circulation between the water in the downcomer path and the water surrounding the tube bundle while sparging gas bubbles were admitted through the blow-down line. While this pump and bubble agitation technique mixed the wet lay-up chemicals throughout the secondary side in a somewhat shorter period of time than bubble-agitation technique alone, it has proved to be expensive and cumbersome since a substantial amount of effort is required by the maintenance personnel to install, operate and remove the pump and various hoses. It has been found that the pump recirculation technique is of such limited effectiveness due to the phenomena known as "streaming" in the art of fluidics. The practical effect of such streaming is that the jet of pressurized water created by the pump passes through the rest of the water largely intact, without mixing. While the effect of such streaming can be counteracted by the installation of a multiplicity of hoses and nozzles, the time loss associated with the installation and removal of additional hoses would more than offset any time gain realized as a result of an increased mixing rate. The pump circulation technique has the additional drawback of increasing the amount of radiation exposure of the maintenance personnel, since they must install and remove the hoses and pump.

Clearly, a new technique for the rapid and uniform mixing of anti-corrosive wet lay-up chemicals within the secondary side of a nuclear steam generator is needed that minimizes both the downtime of the steam generator and the radiation exposure of the maintenance personnel. Ideally, such a technique should be highly reliable, inexpensive, and readily applicable to all models of nuclear steam generators now in existence.

SUMMARY OF THE INVENTION

In its broadest sense, the invention is an improved steam generator having an auxiliary flowpath means for conducting water between the interior of the tube wrapper to the downcomer path when the water level within the secondary shell is too low to allow recirculation between these two regions of the generator. The auxiliary flowpath is selectively operable, so that the normal recirculation path of the water is not interfered with during the normal operation of the generator.

The auxiliary flowpath may include a fitting mounted onto the lower portion of one or more of the water separators enclosed within the upper shell region. The auxiliary flowpath may further include an elbow joint that is detachably connectable onto the fitting for directing a flow of water from the interior of the separator downwardly into the downcomer path defined between the outer surface of the tube wrapper, and the inner surface of the secondary shell. In this embodiment, the auxiliary flowpath may also include a sealing plate that is detachably mountable over the fitting for blocking the flow of water through the fitting when the auxiliary flowpath is not in use. Nuts and bolts secured by fillet welds may be used to secure both the elbow joint and the plate. Alternatively, a manually operable gate valve may be provided between the fitting and the elbow joint for selectively opening the auxiliary flowpath.

In another embodiment of the invention, the auxiliary flowpath may be formed from one or more openings located around the upper edge of the tube wrapper. Each of these openings may be circumscribed by a flange that projects toward the inner surface of the secondary shell. The auxiliary flowpath may further include one or more closure plates that are detachably mountable over the flanges that circumscribe each of the openings in the upper portion of the tube wrapper so that these openings may be closed when the auxiliary flowpath is not in use. In the preferred embodiment, each of these plates is secured onto their respective flanges by means of a plurality of bolts uniformly spaced around the circumference of the flange. In order to ensure that these bolts will not come off, each may be secured by a fillet weld.

The invention further encompasses a method of mixing wet layup chemicals within a steam generator that generally comprises the steps of lowering the level of the water in the secondary shell to a point that breaks the recirculation path within the generator, providing an auxiliary flowpath means within the shell so that water may be circulated from the interior of the tube wrapper to the downcomer path at the reduced water level, injecting wet layup chemicals into the water within the shell, and then simultaneously introducing gas bubbles into the water while circulating water through the auxiliary flowpath until the wet layup chemicals are thoroughly and uniformly mixed throughout all portions of the water inventory within the secondary shell.

The auxiliary flowpath and improved mixing method of the invention provides a greatly improved technique for uniformly mixing anti-corrosion wet lay-up chemicals within the water inventory of a nuclear steam generator in a minimum amount of time. It is readily applicable to all models of nuclear steam generators now in service, and substantially reduces both the downtime of these generators and the amount of radiation exposure incurred by maintenance personnel.

BRIEF DESCRIPTION OF THE SEVERAL FIGURES

FIG. 1A and 1B form a cross-sectional side view of a nuclear steam generator improved in accordance with the invention;

DETAILED DESCRIPTION OF THE PREFERRED EMBODIMENT

Figure 1A:
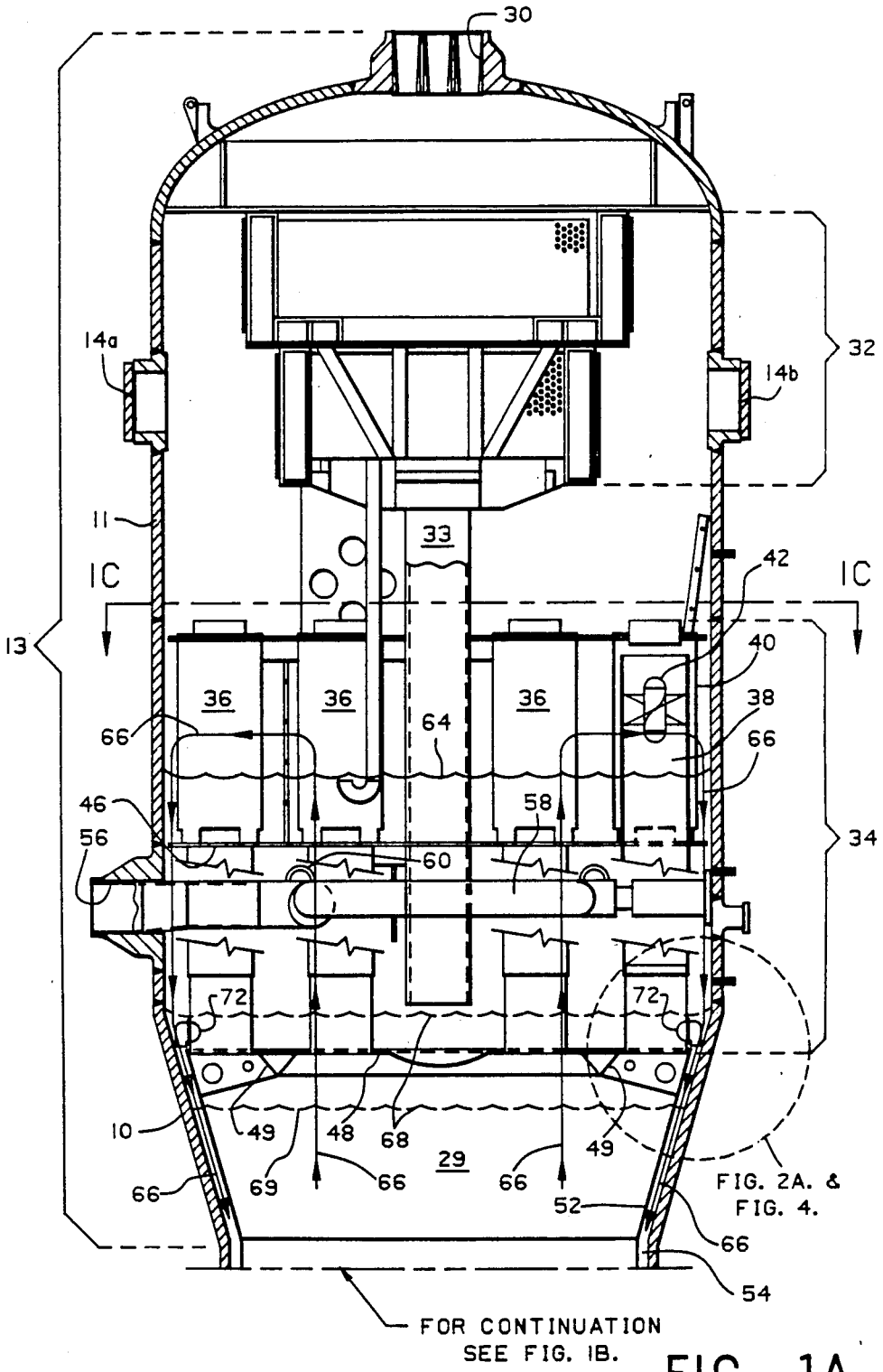
FIG. 1C is a plan view of the nuclear steam generator of FIG. 1A along the line 1C—1C.
Figure 1B:
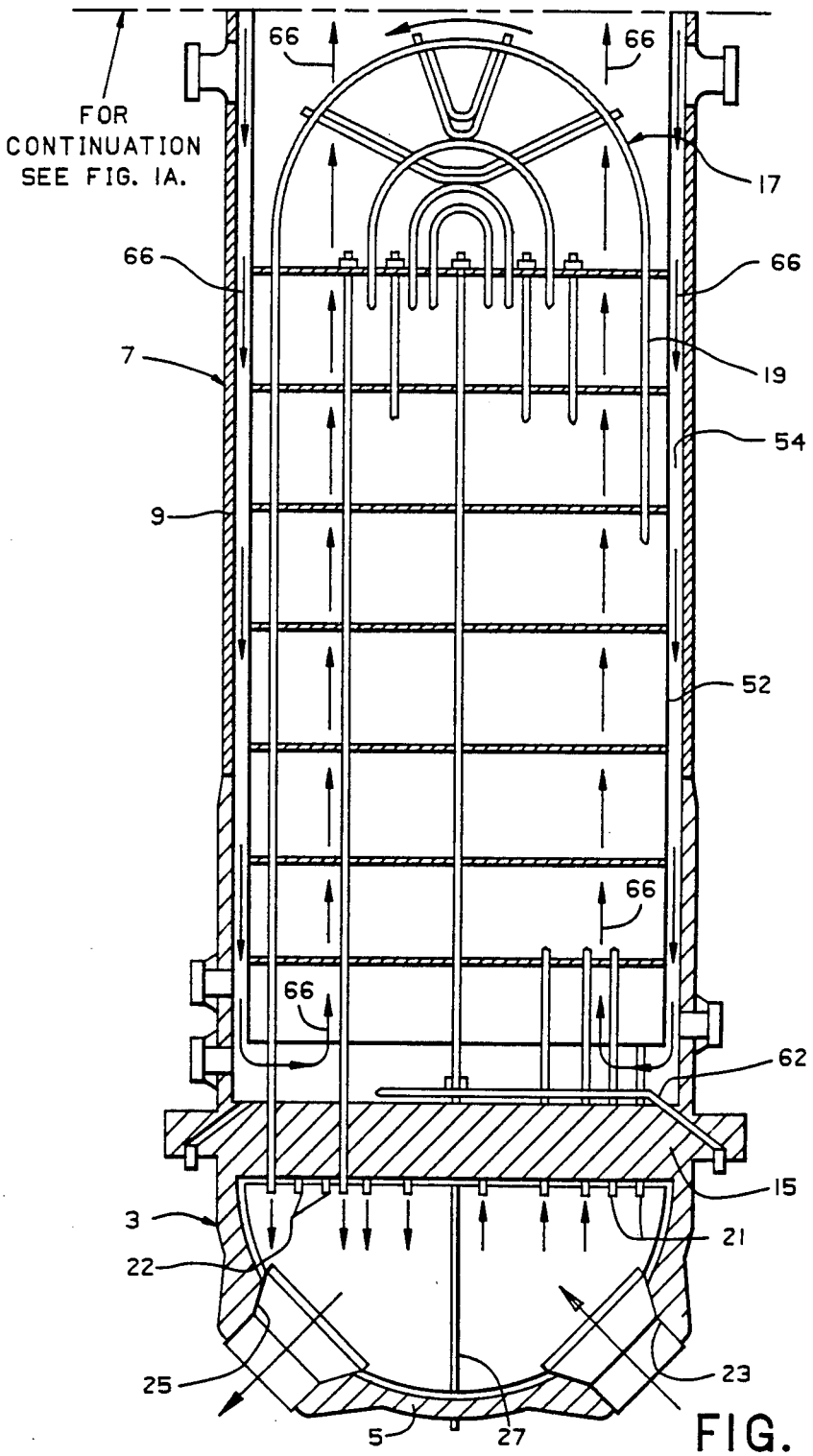
Figure 1C:
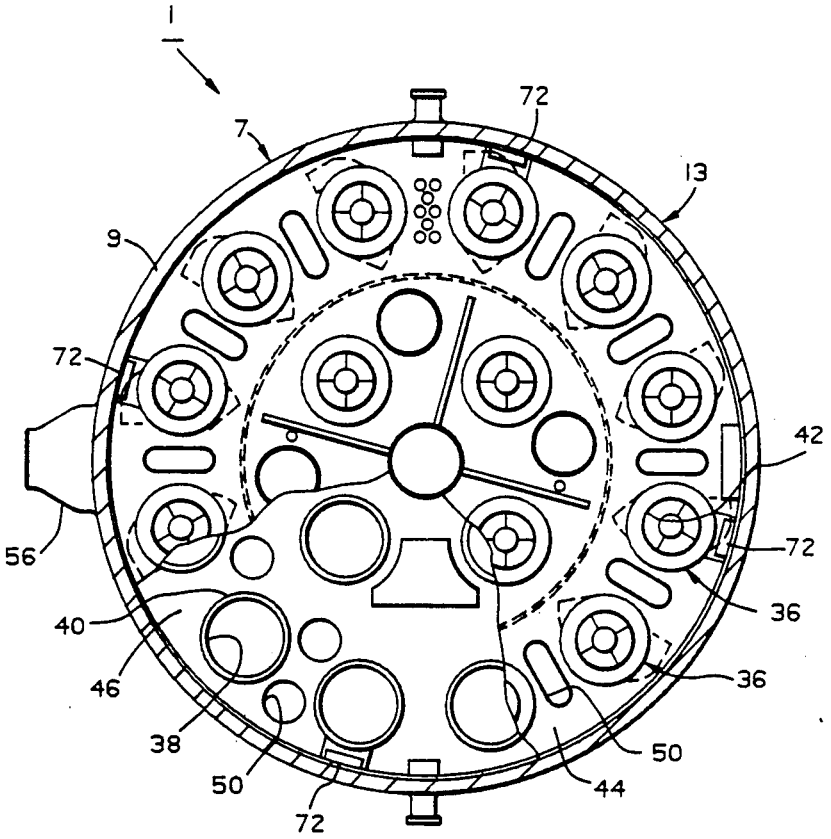

With reference now to FIGS. 1A, 1B, and 1C, wherein like numerals designate like components throughout all of the several figures, the improved nuclear steam generator 1 of the invention includes a primary side 3 in the form of a bowl-shaped vessel 5 that forms the bottom of the generator, and a secondary side 7 in the form of a generally cylindrical shell 9 that forms the middle and top portions of the generator. The upper portion of the cylindrical shell 9 of the secondary side 7 flares out into a conical skirt 10 that melds in with an enlarged portion 11 which forms the upper end of the generator 1. The enlarged portion 11 and its contents form what are known as the upper shell region 13 in the art.

A tubesheet 15 is disposed between the primary side 3 and the secondary side 7, and serves to hydraulically isolate the two sides of the generator 1 from one another. The lower portion of the cylindrical shell 9 of the secondary side 7 houses a bundle 17 of U-shaped heat exchanger tubes 19, as shown. The right-hand legs and the left-hand legs of the U-shaped tubes 19 terminate in open inlet ends 21 and outlet ends 22, each of which may protrude downwardly from the lower surface of the tubesheet 15. The bowl-shaped vessel 5 of the primary side 3, in turn, includes a divider plate 27 for hydraulically isolating the inlet ends 21 of the tubes 19 from their outlet ends 22. This vessel 5 further includes an inlet 23 for admitting hot, radioactive water from the reactor core (not shown) into the inlet ends 21 of the tubes 19, as well as an outlet 25 for discharging this water from the bowl-shaped vessel 5 after it has completely circulated around the U-shaped tubes 19 of the tube bundle 17 and out of the outlet ends 22.

In operation, the shell 9 of the secondary side 7 contains an inventory of water 29 that completely immenses the bundle 17 of U-shaped heat exchanger tubes 19, and the hot, radioactive water that circulates through the interior of these tubes 19 transfers sufficient heat to the water 29 within the shell 9 to cause it to boil and to generate a substantial quantity of usable, non-radioactive steam. The steam generated within the shell 9 of the secondary side rises and ultimately flows out of a steam nozzle 30 located at the top of the upper shell region 13. However, before this steam ultimately flows out of the nozzle 30, it must be dried in order to remove any significant amounts of water droplets that may be entrained in the steam flow. To this end, a secondary and a primary separator bank 32 and 34 are provided at the top and bottom ends of the upper shell region 13, respectively. These separator banks 32, 34 serve two important purposes. First, since the steam produced by such nuclear steam generators 1 is ultimately directed against the turbine of an electric generator at pressures ranging between 900 and 1000 pounds per square inch, any residual water droplets in the steam can cause a significant amount of erosion in the blades of the turbine. Secondly, the water losses that occur as a result of such wet steam increase the amount of water that must be supplied to the steam generator 1, which in turn accelerates the creation of sludge deposits within the secondary side 7. Since such sludge deposits are responsible for much of the corrosion that attacks the heat exchange tubes 19 of the steam generator 1, it is desirable that such water losses through the steam be reduced as much as possible.

The secondary separator bank 32 is generally formed from an array of blades that form a tortuous path which the steam must cross before reaching outlet nozzle 30. A drainpipe 33 centrally disposed throughout the secondary separator bank 32 drains some of the water captured by the blades (not shown) of the secondary separator bank 32, and directs this water back into the water inventory 29. The rest of the water captured by the secondary separator 32 drips down to the primary separator bank 34, where it in turn ultimately flows down an annular downcomer path 54 to be described in more detail hereinafter.

The primary separator bank 34 is formed from a plurality of swirl vane separators 36. Each of the separators 36 includes a generally cylindrical riser barrel 38 that is circumscribed around its uppermost portion by a downcomer barrel 40. A set of pitched blades 42 is mounted within the upper end of each of the riser barrels 38. A helical component of motion is imparted to any stream of wet steam that flows through the riser barrel 38 and on through the blade set 42. This helical component of motion slings out water droplets entrained in the steam flow into an opening (not shown) located at the upper end of each of the riser barrels 38. The resulting separated liquid flows downwardly between the outer surface of the riser barrel 38 and the inner surface of the downcomer barrel 40, and ultimately flows into the previously mentioned annular downcomer path 54 of the generator 1. Each of the swirl vane separators 36 that forms the primary separator bank 34 is secured within the upper shell portion 13 of the secondary side 7 by an upper deck plate 44 that supports the tops of each of the separators 36, a center deck plate 46 that circumscribes the center portions of each of these separators 36, and a lower deck plate 48 that supports the bottoms of each of the downcomer barrels 40 of the separators 36. The lower deck plate 48 includes a plurality of gussets 49 in order to structurally stiffen it, while the upper and center deck plates 46 include a plurality of vent holes 50 for conducting droplets of separated water back to the previously mentioned annular downcomer path 54.

Circumscribing both tube bundle 17 and the inner surface of the shell 9 of the secondary side 7 is a tube wrapper 52. The previously mentioned annular downcomer path 54 of the steam generator 1 is defined between the outer surface of this tube wrapper 52, and the inner surface of the shell 9 and conical skirt 10 of the secondary side 7. As is shown in FIG. 1B, the bottom edge of the tube wrapper 52 is spaced from the top surface of the tubesheet 15. Such spacing allows any water that flows down the annular downcomer path 54 to circulate into the water inventory 29 that immerses the tube bundle 17.

In order to replenish the water inventory 29 in the secondary side 7 that is constantly being converted into steam, the upper shell region 13 includes a feed nozzle 56. The feed nozzle 56 is in turn hydraulically connected to a distributing ring 58 that includes a plurality of J-tubes 60 spaced around its circumference. The J-tubes 60 resemble open elbow joints, which are pointed downwardly toward the upper end of the annular downcomer path 54. Hence, when pressurized feedwater is introduced into the feed nozzle 56, this feedwater is uniformly distributed around the open end of the annular downcomer path 54. Finally, in order to clean sludge deposits that accumulate on top of the tubesheet 15 as a result of the constant boiling away of the water 29, a blow-down line 62 is provided between the upper surface of the tubesheet 15 and the lower edge of the tube wrapper 52. Normally, the function of the blow-down line 62 is to direct a plurality of jets of pressurized water onto the top surface of the tubesheet 15 in order to remove the sludge. However, this blow-down line 62 may also perform the useful function of providing a sparging line during maintenance operations, as will be presently described.

Under normal operating conditions, the level of the water within the shell 9 of the secondary side 7 is at line 64. At such a level, water is free to circulate from the water inventory 29 that surrounds the tube bundle 17 upwardly through the primary separator bank 34 and downwardly into the upper open end of the annular downcomer path 54, as indicated by the flow arrows 66. From thence, the water flows all the way down the annular downcomer path 54 and into the space between the lower edge of the tube wrapper 52, and the upper surface of the tubesheet 15. Because the steam bubbles created around the tube bundle 17 have the effect of lowering the average density of the water inventory 29 contained within the interior of the tube wrapper 52, a positive pressure differential exists between water inventory 29 and the water flowing down through the annular downcomer path 54. This positive pressure differential, in turn, forces a flow of water along the previously described recirculation path 66.

It has been discovered that the aforementioned recirculation path becomes substantially broken whenever the water level within the shell 9 of the secondary side 7 is brought down to a level 68 that allows maintenance operations to be performed within the upper shell region 13. In such maintenance operations, the manways 14A, 14B are typically opened in order to allow service personnel into the upper shell region 13. The ambient air that fills the upper shell region 13 contains oxygen, a significant amount of which becomes dissolved in the water contained within the secondary side 7. If not removed, this dissolved oxygen can either initiate corrosion within the tubes 19 contained within the secondary side 7, or accelerate the production of corrosion at pre-existing corrosion sites. To remove this oxygen, the service personnel typically add wet layup chemicals, such as ammonia and hydrazine, to the water. The ammonia ensures that the pH of the water will not be acidic, and the hydrazine acts as an oxygen scavenger. As a further precautionary measure, pressurized nitrogen gas is introduced through the blow-down line 62 after the service personnel are evacuated from the generator in order to displace all of the oxygen from the upper shell region 13. It has been found that the introduction of pressurized nitrogen through the blow-down line 62 has the further beneficial effect of agitating the water inventory 29 that surrounds the tube bundle 19, which helps to uniformly mix the wet layup chemicals which are injected through the feed nozzle 56, where they ultimately flow through the J-tubes 60 of the distributing ring 58, down the annular downcomer path 54, and out through the space between the lower edge of the tube wrapper 52 and the bottom surface of the tubesheet 15.

Unfortunately, in prior art nuclear steam generators, the uniform admixing of such wet layup chemicals within the secondary side 7 is greatly impeded due to the lack of free circulation between the water within the annular downcomer path 54, and the water inventory 29 surrounding the tube bundle 17. The instant invention solves this problem by the provision of an auxiliary recirculation path 70 located at either the bottom portion of the riser barrels 38 of one or more of the separators 36 (see FIGS. 2A and 2B), or at the upper portion of the tube wrapper 52 (see FIG. 4).

Figure 2A:
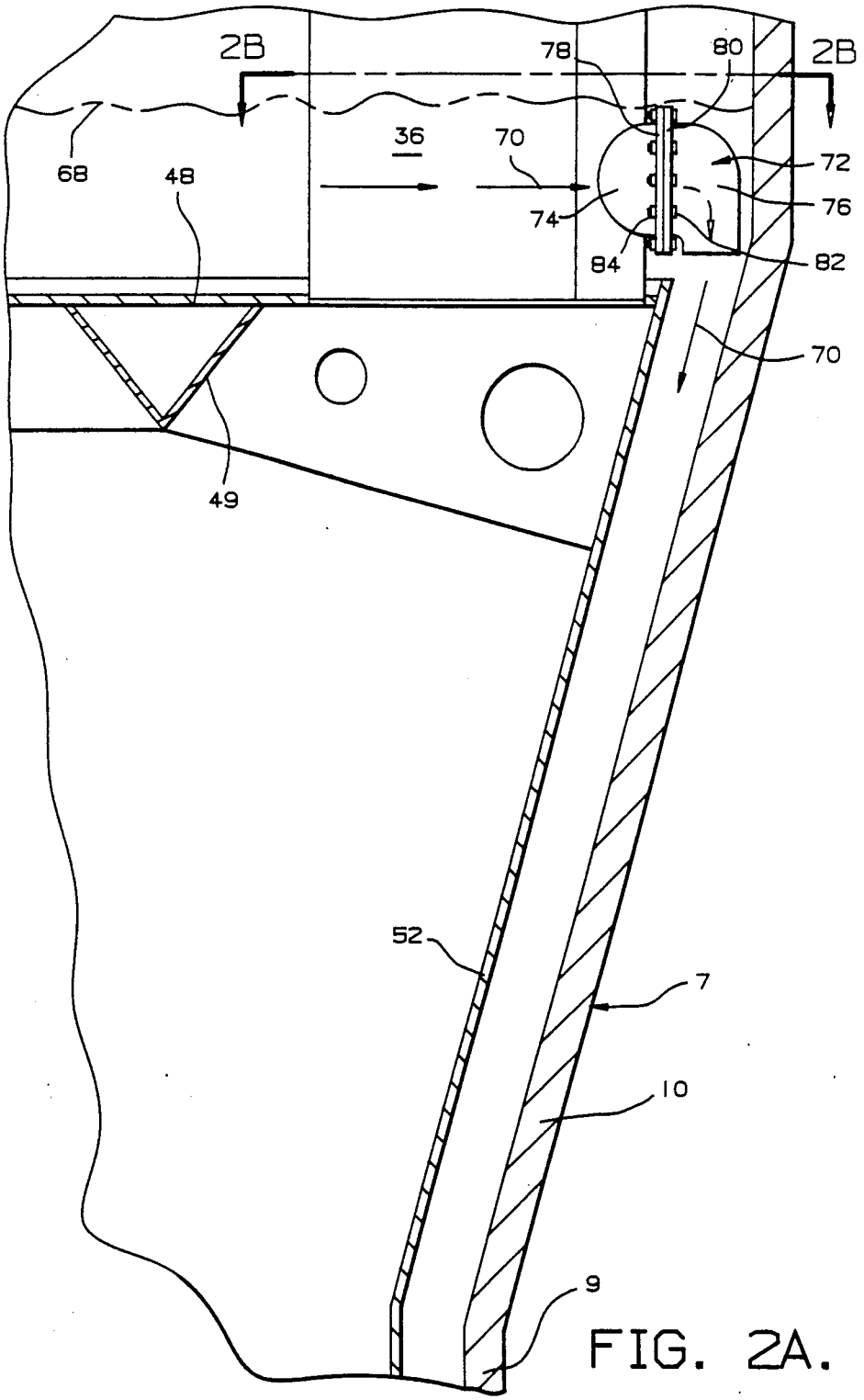
FIG. 2A is an enlarged view of the circled region of FIG. 1A.
Figure 2B:
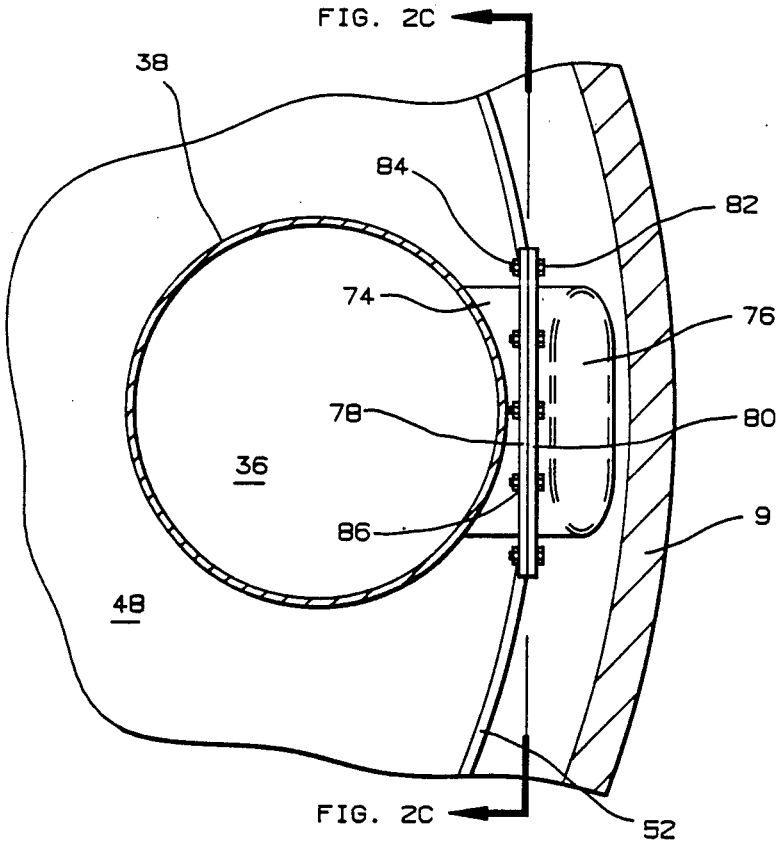
FIG. 2B is a plan view of the portion of the generator illustrated in FIG. 2A along the line 2B—2B, showing one embodiment of the auxiliary flowpath of the invention.

FIG. 2A and 2B illustrate the first preferred embodiment of the recirculation assembly 72 of the invention. The assembly 72 includes a fitting 74 welded onto the lower portion of the riser barrel 38 of four of the swirl vane separators 36 spaced 90° from one another. Sealingly attached to the fitting 74 is an elbow joint 76. To facilitate the interconnection of the fitting 74 and the joint 76, flanges 78 and 80 are provided on each of these components. The flanges 78 and 80 include bolt holes 79 which are mutually registrable for receiving the shanks of a plurality of bolts 82 which are bound thereon by nuts 84. In the preferred embodiment, both the fitting 74 and the elbow joint 76 are elongated with respect to the circumference of the riser barrel 38 in order to provide a maximum flow of water through the auxiliary circulation path 70. Additionally, each of the elbow joints 76 is directed downwardly toward the open end of the downcomer path 54. Finally, each of the bolts 82 and nuts 84 are preferably secured in place by means of small fillet welds 86 to ensure that no loose components will inadvertently fall into the downcomer path 54, where the recirculating water would sweep and rattle them against the heat exchanger tubes 19.

Figure 3:
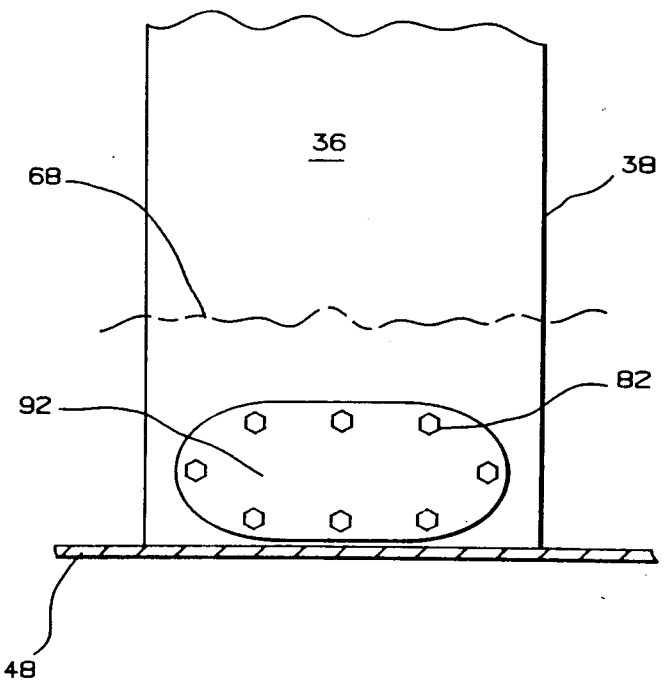
FIG. 3 is a side view of the auxiliary flowpath illustrated in FIG. 2B with the elbow joint removed and a closure plate secured thereon.
Figure 2C:
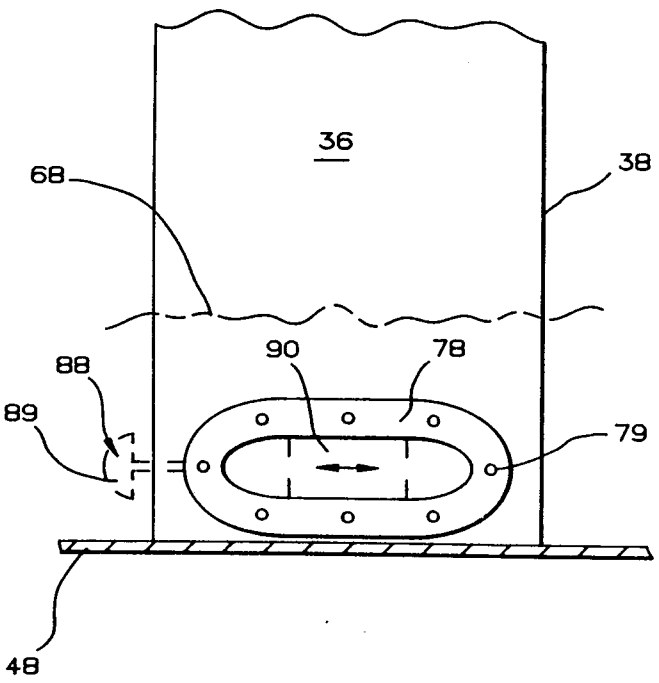
FIG. 2C is a side view of the auxiliary flowpath illustrated in FIG. 2B along the line 2C—2C with the elbow joints removed and a valve installed in phantom.

In order to render the auxiliary circulation path 70 selectively operable, the recirculation assembly 72 may include a gate valve 88 disposed between the flanges 78 and 80 as shown in FIG. 2C. This gate valve 88 would preferably include a handle 89 that opened or closed a conventional fluid gate mechanism 90. Alternatively, the recirculation assembly might be selectively closed by cutting the bolts 82, removing the elbow joint 76, and bolting a closure plate 92 over the flange 78 of the fitting 74, as is illustrated in FIG. 3.

Figure 4:
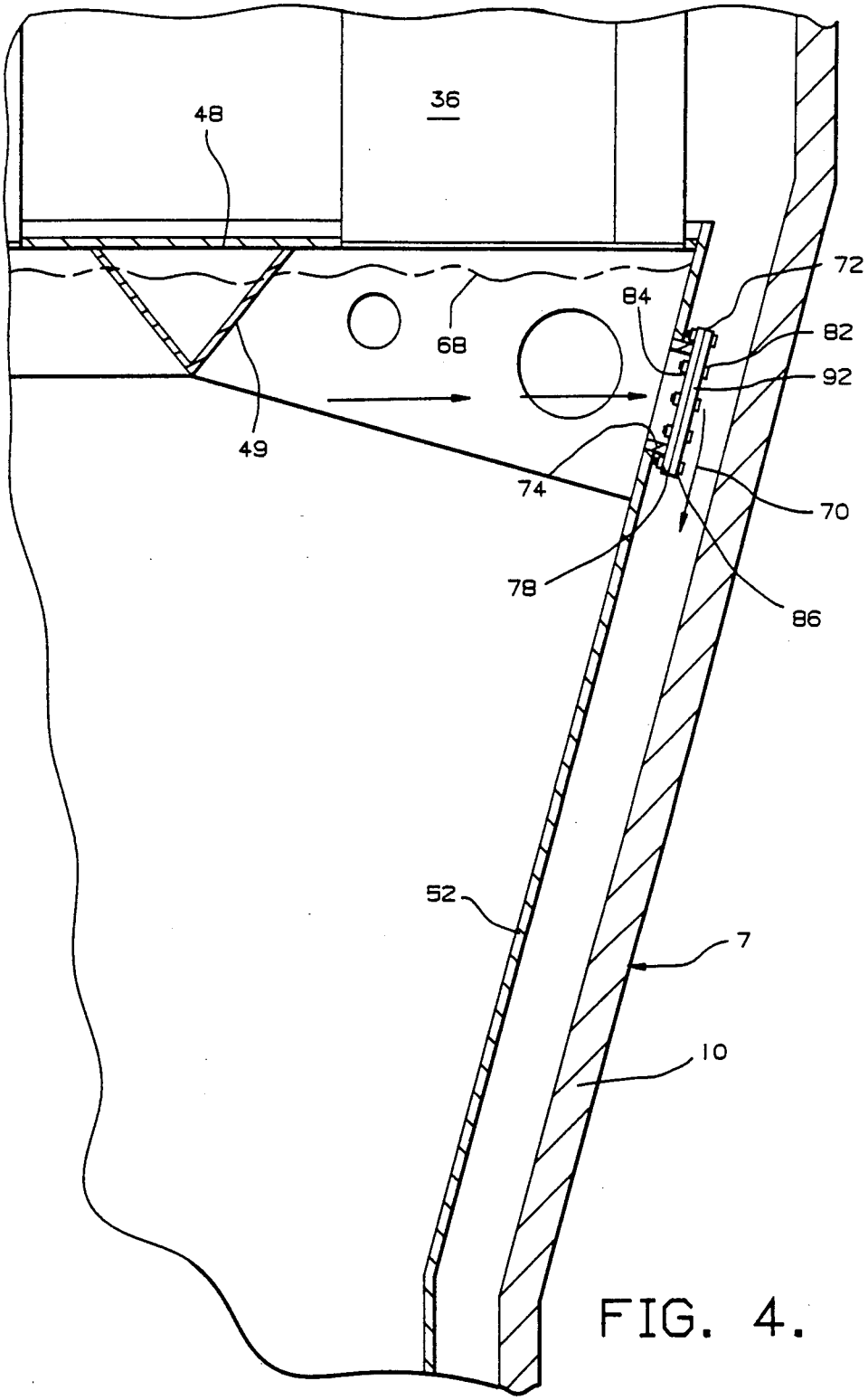
FIG. 4 is a side, cross-sectional view of an alternative embodiment of the auxiliary flowpath of the invention as it appears installed in the upper portion of the tube wrapper of the generator.

FIG. 4 illustrates a second embodiment of the recirculation assembly 72 of the invention. In this embodiment, the fitting 74 is placed at an upper portion of the tube wrapper 52. Because the opening in the fitting 74 directly contacts the annular downcomer path 54, no elbow joint is necessary. Like the previously described embodiment, this second embodiment also includes a closure plate 92 that is sealingly mountable around the flange 78 of the fitting 74 by means of bolts 82 and nuts 84. These bolts 82 and nuts 84 are again preferably secured around the closure plate 92 by fillet welds 86 to prevent any of these parts from loosening and inadvertently falling into the downcomer path 54.

During periods of non-use, the closure plate 92 is mounted over the path of the fitting 74, whether the fitting 74 is located on the riser barrel 38 of one of the primary separators 36, or on an upper portion of the tube wrapper 52. In both embodiments, at least four such fittings 74 are provided, each of which is uniformly spaced 90° from its neighbors in order to facilitate a uniform recirculating flow through the downcomer path 54 (see FIG. 1C). During periods of use, the bolts 82 and nuts 84 are first removed by either grinding away the fillet welds 86, or by cutting the bolts 82. In the case of the first embodiment, the previously mentioned elbow joint 76 is next installed by placing new bolts 82 through the holes 79 in the flanges 78 and 80, and by ringing new nuts 84 on the ends of the shanks of these bolts 82. In the second embodiment, no such installation of an elbow joint 76 is necessary. In all cases, the bolts and nuts 82, 84 are secured by the previously mentioned fillet welds 86.

The improved method of the invention is applicable to both of the preferred embodiments of the improved generator 1 of the invention. In the first step of this method, the water level is lowered within the upper shell region 13 of the generator 1 to level 68 (shown in FIG. 2A and FIG. 4) in order to allow maintenance personnel access to this region 13. If the first embodiment of the invention is used, the water level 68 during sparging is somewhere between the upper edge of the tube wrapper 52 and the ring 58 of the feed nozzle 56 (see FIG. 2A). If the second embodiment of the invention is used, this water level 68 is just below the upper edge of the tube wrapper 52 (see FIG. 4).

After the maintenance operation has been performed, the auxiliary recirculation path 70 is opened by removing the closure plate 92 from the fitting, and by further installing the elbow joints 76 at each of the four recirculation path locations indicated in FIG. 1C if the first embodiment of the invention is used. The repairmen are then evacuated from the upper shell region 13, but the manways 14*a*, 14*b* are left open to allow for depressurization during sparging. Next, pressurized nitrogen is conducted into the secondary shell 9 by introducing it through the blow-down line 62. As soon as the atmosphere in the upper shell region 13 has been substantially replaced with nitrogen, the wet lay-up chemicals are introduced into the secondary shell by conducting them through the distribution ring 58 of the feed nozzle 56. The J-tubes 60 of the ring 58 distribute these chemicals at uniformly spaced points around the circumference of the ring 58, where they ultimately flow into the annular downcomer path 54. Because the nitrogen bubbles have caused the water on the inside of the tube wrapper 52 to be less dense than the water in the downcomer path 54, and because the auxiliary recirculation path 70 is below the level 68 of this water, the water within the secondary shell 9 freely circulates through the tube bundle 17, over the upper portion of the tube wrapper 52, through the downcomer path 54, and back through the bottom of the tube bundle 17. While this recirculation is occurring, the nitrogen bubbles agitate and thoroughly mix the water inventory 29 around the tube bundle 17 as it passes through the inside of the wrapper 52.

After the mixing has been completed, one of the manways 14*a*, 14*b* is opened briefly to allow a repairman to re-install the closure plate 92 over the fitting 74 at each of the four locations shown in FIG. 2C. The positive pressure of the nitrogen within the secondary shell 9 prevents any significant amount of atmospheric oxygen from re-entering the upper shell region 13. To compensate for the lack of oxygen, the repairman carries his own supply by way of a scuba-like mechanism. After the closure plates 92 are reinstalled, the repairman leaves the upper shell region 13, and the generator is brought back on line. In all cases of removal and installation, bolts 82, nuts 84 and fillet welds 86 are preferably used to secure the plates 92 or elbows 76 into position. However, it should be noted that the apparatus of the invention is not confined to the use of such bolt and nut securing means, and that other forms of detachable mountings, such as rail-and-track "windowpane" type mountings between the plates 92 and fittings 74 are also contemplated. With respect to the method of the invention, it should be noted that the wet lay-up chemicals may alternatively be added at more than one time during the maintenance operation.

I claim:

1. An improved steam generator of the type having a shell that contains a quantity of water, at least one heat exchanger tube for converting the water to steam, a tube wrapper means surrounding the tube within the shell for defining a downcomer path, and a first flow path for conducting a flow of water from the interior of the tube wrapper means to the downcomer path when the water level within the shell is at an operational level, wherein the improvement comprises an auxiliary flowpath means for conducting water between the interior of the tube wrapper means to the downcomer path when the water level within the shell is below said operational level.

2. An improved steam generator of the type having a primary side and a secondary side, wherein said secondary side includes a shell that contains a quantity of water, a bundle of heat exchanger tubes for converting the water into steam, a tube wrapper means spaced from the inner surface of the shell and surrounding the tube bundle for defining a downcomer path around the inner surface of the shell, said tube wrapper means terminating in an upper edge, and first flow path for conducting a circulating flow of water between the interior of the tube wrapper means and the downcomer path when the water level within the shell is higher than said upper edge, wherein the improvement comprises a selectively operable auxiliary flowpath means for conducting water between the interior of the tube wrapper means and the downcomer path when the water level in the shell is too low to allow said first flow path to conduct said circulating flow of water.

3. The generator of claim 2, wherein said selectively operable flow path means is capable of conducting water between the interior of the tube wrapper and the downcomer path when the level of the water within the shell is below the upper edge of the tube wrapper.

4. The generator of claim 2, wherein said secondary side includes an upper shell portion that contains at least one separator for separating water out of wet steam, and wherein the first flow path conducts water through an upper portion of said separator, and said auxiliary flow path means selectively conducts water through a lower portion of said separator.

5. The generator of claim 4, wherein said auxiliary flow path means includes a fitting mounted onto said lower portion of said separator.

6. The generator of claim 5, wherein said auxiliary flow path means further includes an elbow joint for directing a flow of water from the interior of the separator to the downcomer path.

7. The generator of claim 6, wherein said elbow joint is detachably mountable onto said fitting, and wherein said auxiliary flow path means further includes a plate means for sealing said fitting when said elbow joint is not mounted thereon.

8. The generator of claim 6, wherein said auxiliary flow path means further includes a valve means mounted between the fitting and the elbow joint for selectively opening said auxiliary flow path means.

9. The generator of claim 2, wherein said auxiliary flow path means includes an opening located in an upper portion of the tube wrapper means, and a detachably connectable plate for closing said opening when said auxiliary flow path means is not in use.

10. The generator of claim 9, wherein said plate is detachably connectable on the outside surface of the tube wrapper means.

11. An improved steam generator of the type having a primary side and a secondary side, wherein said secondary side includes a shell that contains a quantity of water, a bundle of heat exchanger tubes for converting the water into steam, a tube wrapper means spaced from the inner surface of the shell and surrounding the tube bundle for defining a downcomer path around the inner surface of the shell, said tube wrapper means terminating in an upper edge, and said shell terminating in an upper shell region positioned above said upper edge of the tube wrapper means, said upper shell region having a first flow path for conducting a circulating flow of water between the interior of the tube wrapper means and the downcomer path when the water level within the shell is above a first level within the shell, wherein the improvement comprises a selectively operable auxiliary flow path means for conducting a circulating flow of water between the interior of the tube wrapper means and the downcomer path when the water level within the shell is lower than said first level within the shell.

12. The generator of claim 11, wherein said shell includes a means for introducing gas bubbles into the water in order to bubble-agitate said water within said shell, and wherein said auxiliary flow path means selectively conducts a circulating flow of water between the interior of the tube wrapper means and the downcomer path when the level of the bubble agitated water is below said first level within said shell.

13. The generator of claim 12, wherein said upper shell portion includes at least one separator for separating water out of wet steam, and wherein the first flow path conducts water through an upper portion of the separator, and said auxiliary flow path means selectively conducts water through a lower portion of said separator.

14. The generator of claim 13, wherein said auxiliary flow path means includes a fitting mounted onto said lower portion of said separator.

15. The generator of claim 14 wherein said auxiliary flow path means further includes an elbow joint for directing a flow of water from the interior of the separator to the downcomer path.

16. The generator of claim 15 wherein said elbow joint is detachably mountable onto said fitting, and wherein said auxiliary flow path means further includes a plate means for sealing said fitting when said elbow joint is not mounted thereon.

17. The generator of claim 15, wherein said auxiliary flow path means further includes a valve means mounted between the fitting and the elbow joint for selectively opening said auxiliary flow path means.

18. The generator of claim 11, wherein said auxiliary flow path means includes an opening located in an upper portion of the tube wrapper means, and a detachably connectable plate for closing said opening when said auxiliary flow path means is not in use.

19. The generator of claim 18, wherein said plate is detachably connectable on the outside surface of the tube wrapper means.

20. An improved nuclear steam generator of the type having a primary side and a secondary side, wherein said secondary side includes a shell that contains a quantity of water, a bundle of heat exchanger tubes for converting the water into steam, a tube wrapper means spaced from the inner surface of the shell and surrounding the tube bundle for defining a downcomer path around the inner surface of the shell, said tube wrapper means terminating in an upper edge, and said shell having a means for introducing pressurized gas in order to bubble agitate the water within the shell during maintenance operations, an upper shell region, and a first flow path within said upper shell region that conducts a circulating flow of water between the interior of the tube wrapper means and the downcomer path when the water level within the shell is above a first level within said shell, but which does not conduct said circulating flow of water when said water level is at a second level that is below said first level and associated with maintenance operations, wherein the improvement comprises a selectively operable auxiliary flow path means for conducting a circulating flow of water between the interior of the tube wrapper means and the downcomer path when the water level within the shell is at said second level.

21. The generator of claim 20 wherein said selectively operable flow path means is capable of conducting water between the interior of the tube wrapper and the downcomer path when the level of the water within the shell is below the upper edge of the tube wrapper.

22. The generator of claim 21, wherein said upper shell portion includes at least one separator for separating water out of wet steam, and wherein the first flow path conducts water through an upper portion of the separator, and said auxiliary flow path means selectively conducts water through a lower portion of said separator.

23. The generator of claim 22, wherein said auxiliary flow path means includes a fitting mounted onto said lower portion of said separator.

24. The generator of claim 23, wherein said auxiliary flow path means further includes an elbow joint is detachably mountable onto said fitting, and a plate means for sealing said fitting when said elbow joint is not mounted thereon.

25. The generator of claim 22, wherein said auxiliary flow path means further includes a valve means mounted between the fitting and the elbow joint for selectively opening said auxiliary flow path means.

26. The generator of claim 20 wherein said auxiliary flow path means includes an opening located in an upper portion of the tube wrapper means, and a detachably connectable plate for closing said opening when said auxiliary flow path means is not in use.

27. A method of mixing wet lay-up chemicals within a steam generator of the type including a shell that contains a quantity of water, at least one heat exchanger tube for converting said water into steam, a tube wrapper means surrounding the tube within the shell for defining a downcomer path, a means for selectively introducing gas bubbles into the water in order to agitate the water within said shell, and a first flow path for conducting a circulating flow of water from the interior of the tube wrapper means to the downcomer path only when said water level is above a first level, comprising the steps of:

(a) lowering the level of the water in the shell to a second level that is lower than said first level;

(b) providing an auxiliary flow path means within said shell for selectively conducting a circulating flow of water from the interior of the tube wrapper means to the downcomer path when said water is at said second level;

(c) injecting selected chemicals into the water within said shell in order to control the chemistry of said water, and (d) introducing gas bubbles into said water while simultaneously circulating water from the interior of the tube wrapper means to the downcomer path through said auxiliary flow path means in order to mix and uniformly distribute said chemicals throughout the water in said shell.

28. The method of claim 27, wherein said auxiliary flow path means includes a valve, and wherein said circulating flow of water is effected by opening said valve.

29. The method of claim 27, wherein said auxiliary flow path means includes an opening located in an upper portion of the tube wrapper means, and a plate that is detachably mountable over said opening, and wherein said circulating flow of water is effected by detaching said plate.

30. The method of claim 27, wherein said shell includes an upper shell region that contains at least one separator for separating water from steam, and wherein said first flow path is defined in part by an upper portion of said separator, and said auxiliary flow path includes an opening in a lower portion of the separator, a detachably mountable elbow joint for directing a circulating flow of water between the inner surface of the shell and the outer surface of the tube wrapper means when said auxiliary flow path means is in use, and a detachably mountable plate for selectively sealing said opening when said auxiliary flow path means is not in use.

* * * * *